United States Patent [19]

Konzal

[11] Patent Number: 4,571,233

[45] Date of Patent: Feb. 18, 1986

[54] PAPER CONTAINER BOTTOM EXPANDER

[75] Inventor: Daryl R. Konzal, Colgate, Wis.

[73] Assignee: Paper Machinery Corporation, Milwaukee, Wis.

[21] Appl. No.: 568,815

[22] Filed: Jan. 6, 1984

[51] Int. Cl.[4] ..... B31B 1/90; B31B 1/28

[52] U.S. Cl. ..... 493/109; 493/158; 493/474; 72/400; 279/2 R

[58] Field of Search ..... 493/109, 108, 158, 474, 493/475; 156/69, 580; 29/243.52; 72/400; 279/2 R

[56] References Cited

U.S. PATENT DOCUMENTS

| | | | |
|---|---|---|---|
| 1,186,466 | 6/1916 | Brown | 493/474 |
| 1,853,192 | 4/1932 | Benke | 493/474 |
| 2,703,952 | 3/1955 | Perriguey | 493/109 |
| 2,911,890 | 11/1959 | Miller | 279/2 |
| 3,542,383 | 11/1970 | Farley et al. | 493/474 |
| 3,704,837 | 12/1972 | Heinz et al. | 279/2 |
| 4,000,708 | 1/1977 | Hardt | 29/243.52 |

FOREIGN PATENT DOCUMENTS

| | | | |
|---|---|---|---|
| 793415 | 1/1936 | France | 493/109 |
| 1358601 | 3/1964 | France | 493/158 |

*Primary Examiner*—Daniel C. Crane

*Attorney, Agent, or Firm*—James E. Nilles

[57] ABSTRACT

A bottom expander for a flat bottom paper container of noncircular cross-section comprises a ring having an aperture surface for closely embracing the bottom rim of a container and plate-like tool elements, each having a radially outer edge surface which opposes and clampingly cooperates with that aperture surface. Each tool element is fastened to the front end of a leaf spring, the rear end of which is anchored in fixed relation to a support for the ring. The leaf springs support the tool elements in coplanar relation and so flex as to confine the tool elements to translatory motion that carries their outer edge surfaces toward and from the aperture surface, thus eliminating sliding guidance for the tool elements. The leaf springs also bias the tool elements to home positions in which they are spaced from the aperture surface.

6 Claims, 11 Drawing Figures

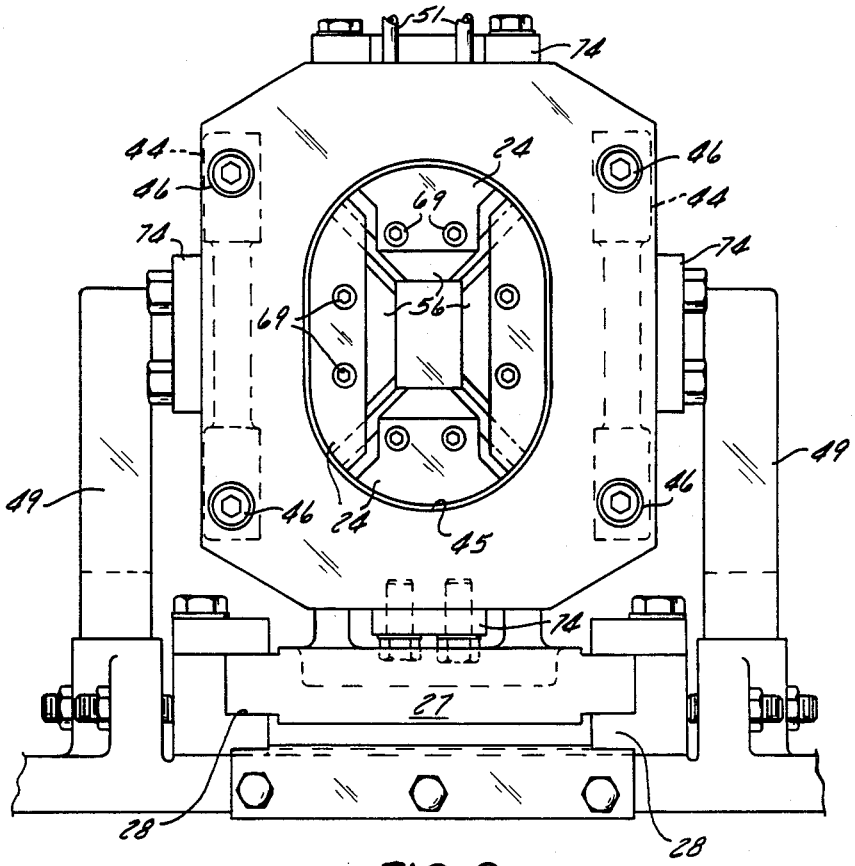
FIG. 3
FIG. 4
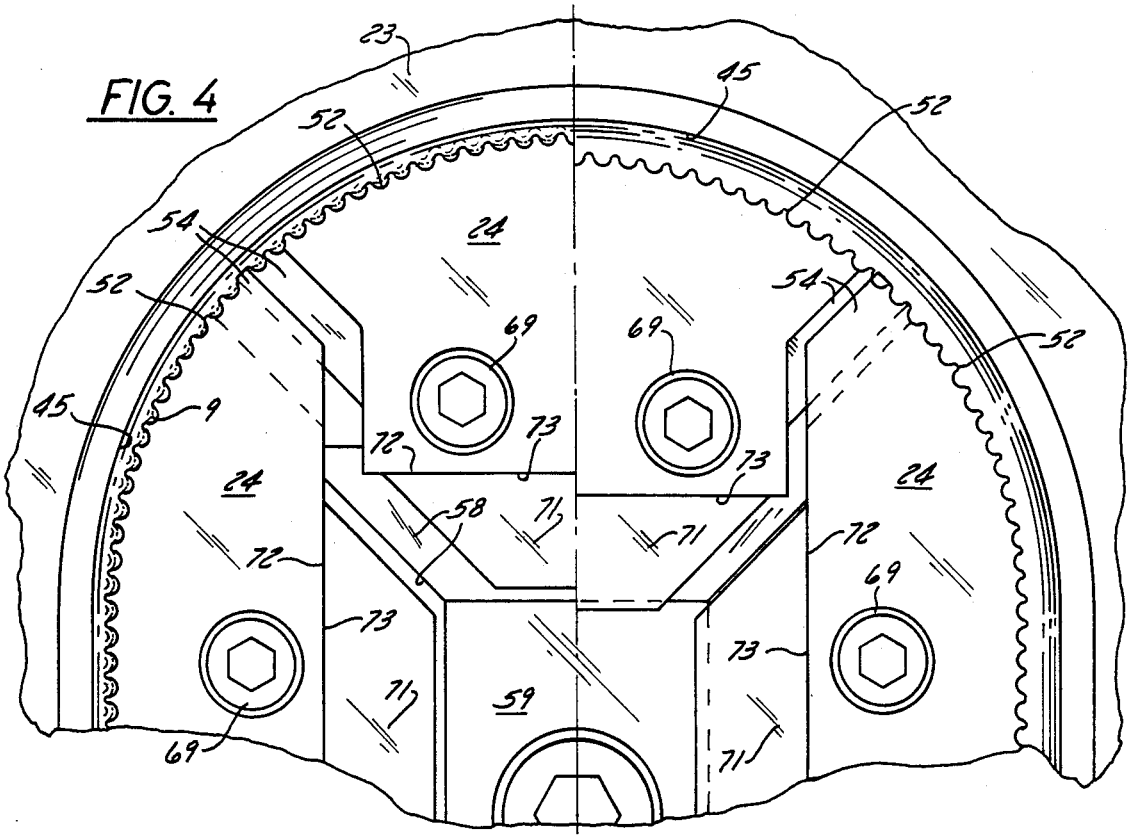

PAPER CONTAINER BOTTOM EXPANDER

FIELD OF THE INVENTION

This invention relates generally to machines for making paper containers that comprise a bottom blank surrounded by a side blank; and the invention is more specifically concerned with an improved bottom expander for a paper container machine whereby contiguous portions of the blanks for a container, at a bottom rim of the container, are forced into bonding engagement with one another to form a seal around that rim. The invention is particularly useful in machines for making containers that have a non-circular bottom wall.

BACKGROUND OF THE PRIOR ART

A machine for making flat-bottom two-piece containers of paper and paper-like materials usually has a turret which is stepwise rotatable about a vertical turret axis and which comprises a number of mandrels that have their axes radial to the turret axis and disposed at uniform angles around it. Stepwise rotation of the turret brings every mandrel to each in turn of a succession of stations that are space around the mandrel orbit.

Each mandrel has a flat face at its end remote from the turret axis and tapers along its length to that face. At one of the stations to which the mandrel is brought, a bottom blank for a container to be formed is applied flatwise to the end face of the mandrel and held in place there by suction inlets in that face. A side blank is then wrapped snugly around the mandrel to bring its opposite side edge portions into overlapping relationship, and those overlapped portions are clamped against the mandrel and thus bonded to one another to form a side seam.

To provide for formation of a bottom seam at which the side blank is sealed to the bottom blank, the bottom blank has a peripheral flange that projects away from the turret axis and the side blank is wrapped around the mandrel in a position to project beyond the end face of the mandrel and surround the flange. The flange and its contiguous portion of the side blank thus comprise a bottom rim on the container. Usually the side blank initially projects a substantial distance beyond the flange on the bottom blank, and the machine has a station at which this projecting portion of the side blank is rolled radially inwardly and back over the flange to bring the bottom rim to a condition in which the flange is sandwiched between portions of the side blank. The mandrel is then swung to a bottom expander station at which the sandwiched layers of the bottom rim are clamped into tight engagement with one another so that thermoplastic coating on the blanks, previously heated to its molten state, can bond those layers to a liquid-tight bottom seam for the container.

The bottom expander conventionally comprises a shuttle that is movable back and forth in directions parallel to the axis of a mandrel that has been brought to the bottom expanding station. As the mandrel is moving into that station, the shuttle is in a rearward retracted position at which the bottom expander is clear of the mandrel and the container blanks on it. When turret rotation stops, the shuttle moves forward to carry bottom expander tooling thereon into operative relationship to the bottom rim of the container on the turret.

The bottom expander tooling comprises an outer tool which is fixed to the shuttle and which is in the form of a ring that surrounds the bottom rim of the container, and inner tooling which is movable relative to the shuttle to clamp the layers of the bottom rim against the ring. For a container having a non-circular bottom, the inner tooling comprises a plurality of plate-like tool elements that are actuated by a driver which moves back and forth along an axis in the shuttle. The several tool elements are disposed in a common plane that is normal to the driver axis, and each has a radially outer edge surface that is configured for clamping cooperation with a portion of the ring. The front end portion of the driver is formed as a substantially pyramidal head with forwardly convergent driving surfaces, and each tool element is fixed to a carrier that has an oblique driven surface which so complements and cooperates with one of the driving surfaces on the driver head that forward movement of the driver wedgingly propels the tool elements radially outwardly for their clamping cooperation with the ring.

In prior bottom expanders for noncircular containers, the tool element carriers were confined to radial in and out movements by cooperating sliding guide surfaces on them and on the shuttle, and they were biased radially inwardly towards their normal positions by coiled compression springs reacting between them and the shuttle. The guide surfaces had to be very accurately machined so that they would confine the tool elements to radial in and out motion and against play in other directions while nevertheless providing clearances adequate to prevent binding. Notwithstanding the precision that had to be maintained in these guide surfaces, they were subjected to severe pounding during operation of the bottom expander because the driver moves forward at high speed, and its oblique driving surfaces therefore impose large forward forces upon the tool element carriers. As a result, the guiding surfaces soon became worn, and the tool element carriers had to be replaced frequently. This was expensive, not only in down time on the machine but in the cost of each replacement carrier itself, inasmuch as the carrier was a precision-made part of complicated shape.

SUMMARY OF THE INVENTION

The general object of this invention is to provide a bottom expander of the character described wherein there are no sliding surfaces on the tool element carriers that guide them in radial in and out motion, but wherein the tool elements are nevertheless accurately confined to such motion.

Thus it is another general object of the invention to provide a bottom expander wherein the only wear surface on each tool element carrier is its driven surface that is slidingly engaged by the oblique driving surface on the driver, and wherein the tool element carriers consequently have a very long useful life and seldom need replacement.

A further object of this invention is to provide a bottom expander having tool element carriers which are of less complicated shape, and which therefore are less expensive, than the tool element carriers of prior bottom expanders.

Another and more specific object of this invention is to provide a bottom expander for a machine for making two-piece paper containers wherein the means for guiding the tool elements in their radial in and out movements not only supports them and confines them to such movements but also serves to bias them towards a normal position from which the driver propels them radially outwardly by its forward movement.

These and other objects of the invention that will appear as the description proceeds are achieved in the bottom expander of this invention, which is incorporated in a machine for making cup-like paper containers, each comprising a bottom blank and a side blank. The bottom expander serves to force contiguous portions of the blanks for a container, at a bottom rim thereof, into bonding engagement with one another to form a seal around that rim, and it comprises, in general, a shuttle that defines an axis, a plurality of plate-like tool elements disposed in a plane normal to that axis and each having a radially outer rim engaging surface, means on each tool element defining a radially inner driven surface, and a driver carried by the shuttle for movement forward and rearward relative to it along said axis and having driving surfaces that converge forward toward said axis and cooperate with said driven surfaces to drive the tool elements radially outwardly from retracted positions thereof upon forward movement of the driver. The bottom expander of this invention is characterized by a plurality of elongated leaf springs, one for each tool element, each having a front end portion and a rear end portion. Each leaf spring has its tool element fixed to its front end portion to be supported by the leaf spring and has its rear end portion so fixed to the shuttle that, when unflexed, its length is substantially parallel to said axis and its tool element is in its retracted position; and each leaf spring is flexible substantially only in directions that carry its front end toward and from said axis.

Preferably said means on each tool element defining a radially inner driving surface comprises a carrier which provides a connection between the tool element and the front end portion of the leaf spring and to which the tool element has a rigid but readily detachable securement, to be interchangeable with other tool elements of different shapes and sizes.

It is also preferred that the bottom expander of this invention further comprise biasing means reacting between the shuttle and the front end portion of each leaf spring to yieldingly resist movement of the front end portion of the leaf spring in the direction away from said axis and thereby impose upon the leaf spring a compound flexure whereby its tool element is confined to substantially translatory movement toward and from said axis.

BRIEF DESCRIPTION OF DRAWINGS

In the accompanying drawings, which illustrate what is now regarded as a preferred embodiment of the invention:

FIG. 3 shows the bottom expander in front elevation, with the tool elements in their extended positions;

FIG. 4 is a fragmentary front elevation view of the bottom expander on a larger scale, the tool elements being shown in their extended container-engaging positions in the left half of the figure and in their unextended or home positions in the right half of the figure.

DETAILED DESCRIPTION OF PREFERRED EMBODIMENT OF THE INVENTION

Figure 9:
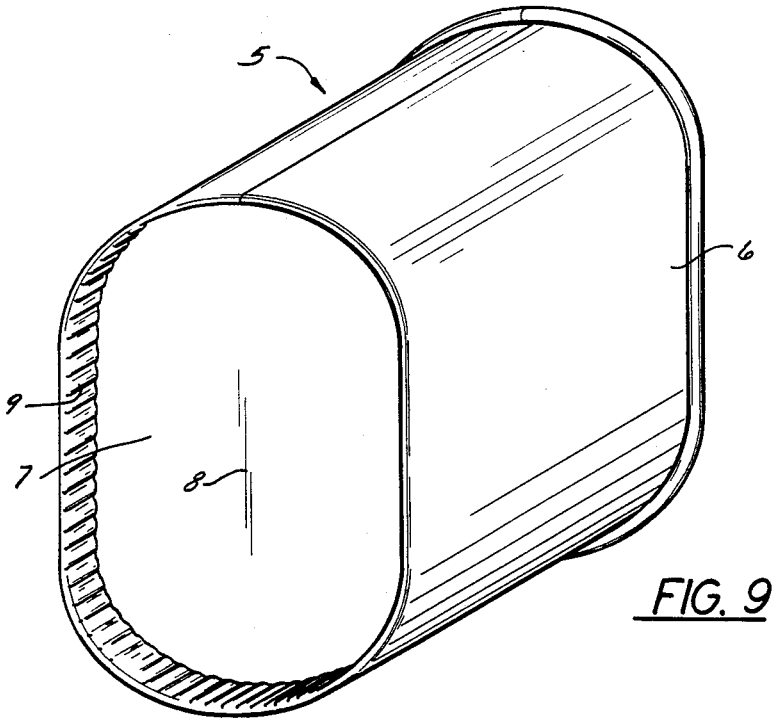
FIG. 9 is a bottom perspective view of a container produced on a machine having a bottom expander of this invention.
Figure 10:
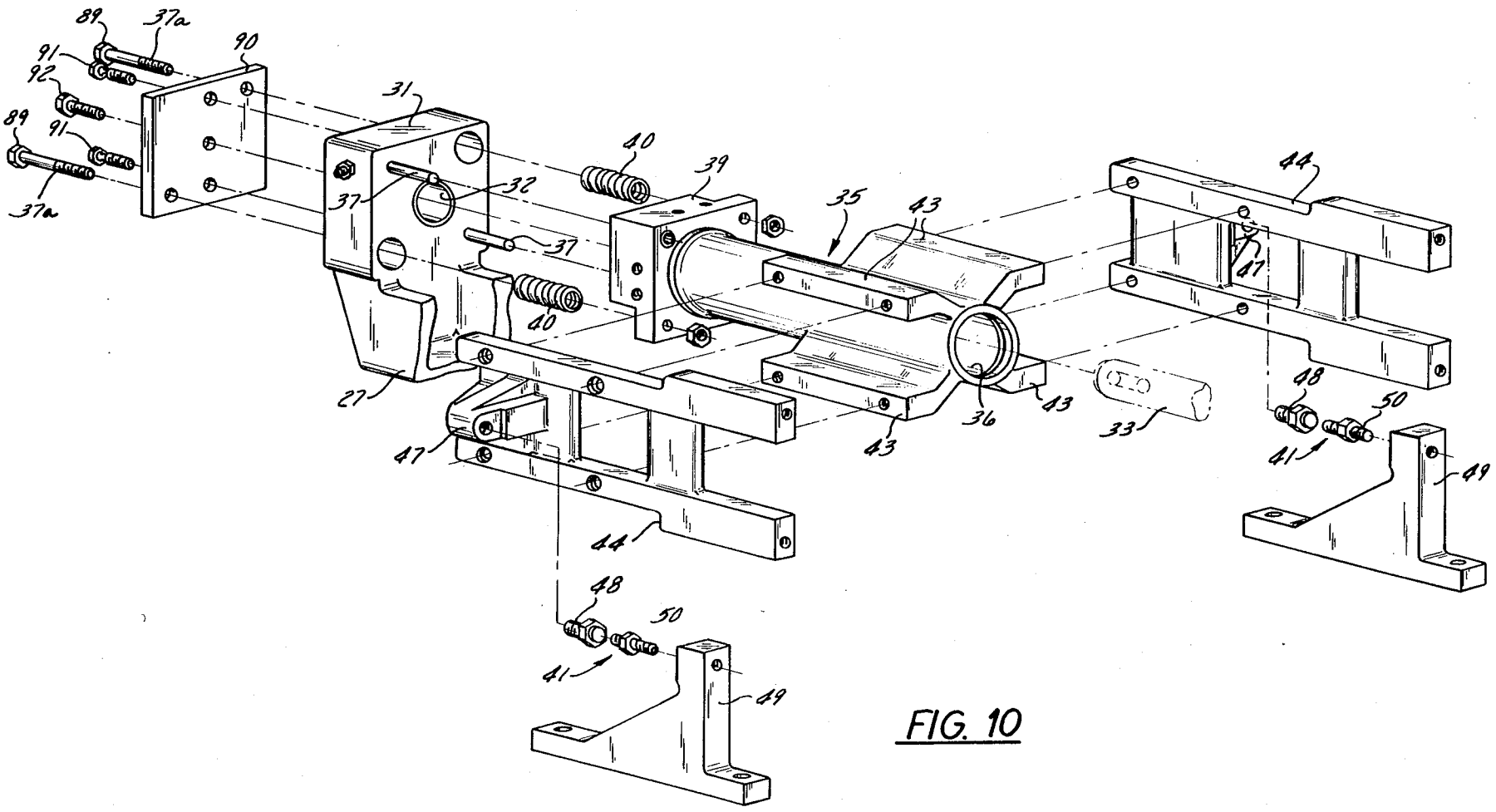
FIG. 10 is an exploded perspective view of parts of the bottom expander that comprise the shuttle.
Figure 11:
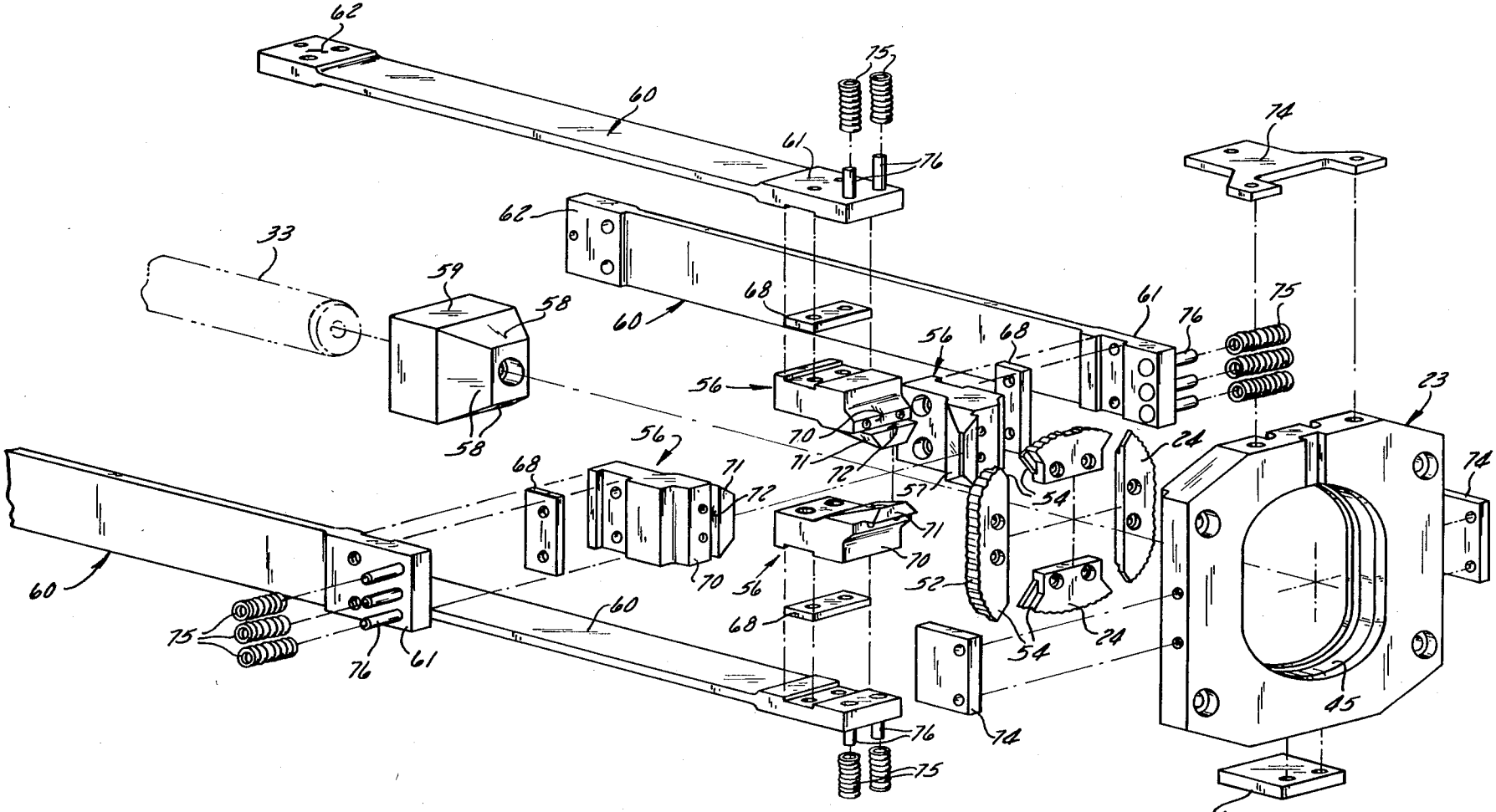
FIG. 11 is an exploded perspective view of the tooling and the means for actuating and guiding it.

A machine comprising a bottom expander of this invention is intended for making cup-like two-piece paper containers that are generally of the type represented by the container 5 in FIG. 9, each formed from a side blank 6 and a bottom blank 7. The invention is primarily useful for the production of containers that are non-circular in cross-section, as distinguished from the more common frustoconical paper cups. The racetrack cross-section of the container 5 (FIG. 9) is merely representative, and the invention is also applicable to the production of containers that are of oval or elliptical cross-section, or are square or rectangular with rounded corners. In any case, the side blank 6 will project some distance below the flat bottom wall 8 to provide a bottom rim 9 on the container.

Figure 1:
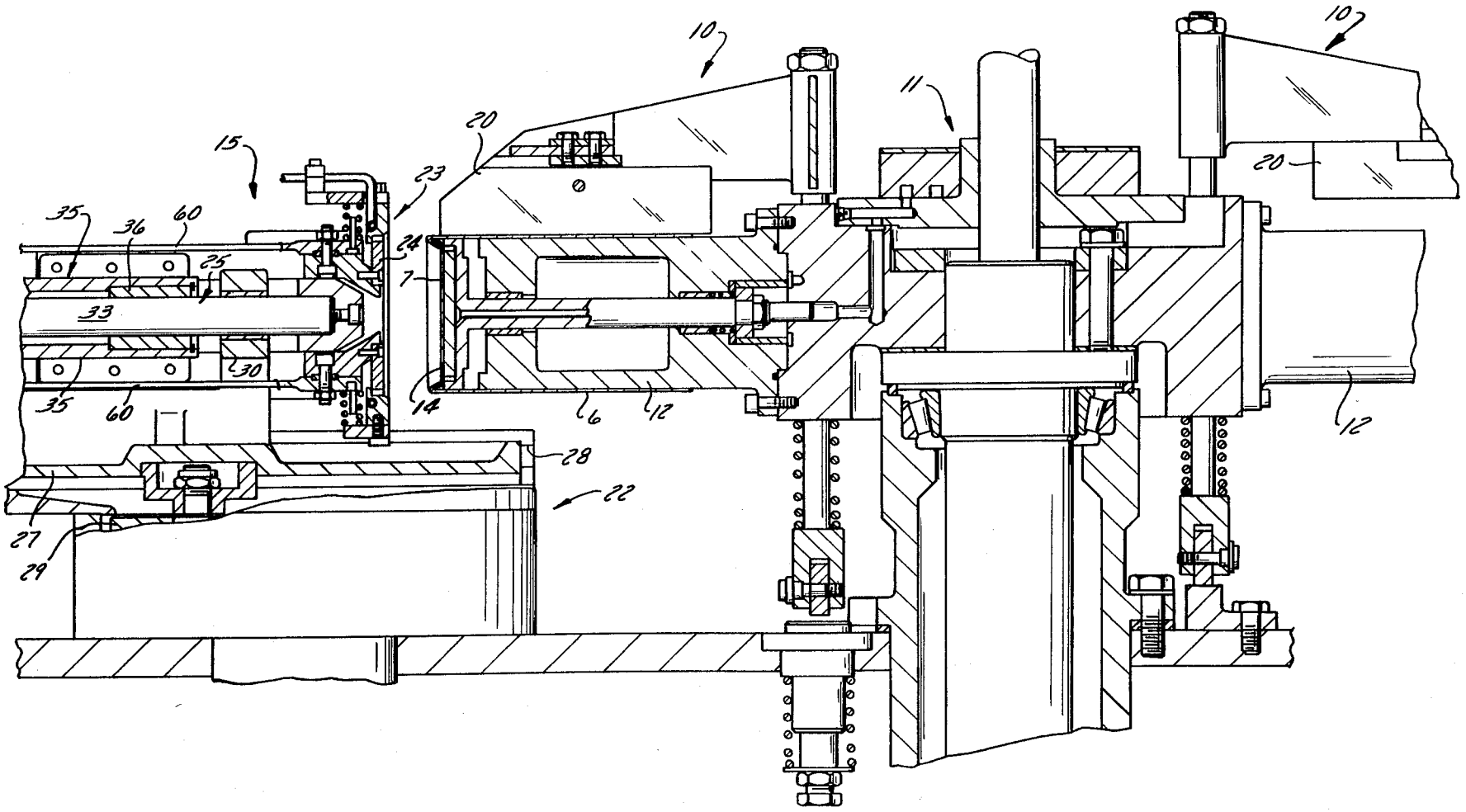
FIG. 1 is a fragmentary view in vertical section through a paper container making machine, taken on a plane containing the rotational axis of the machine turret and the axis of the station comprising the bottom expander of this invention.
Figure 2:
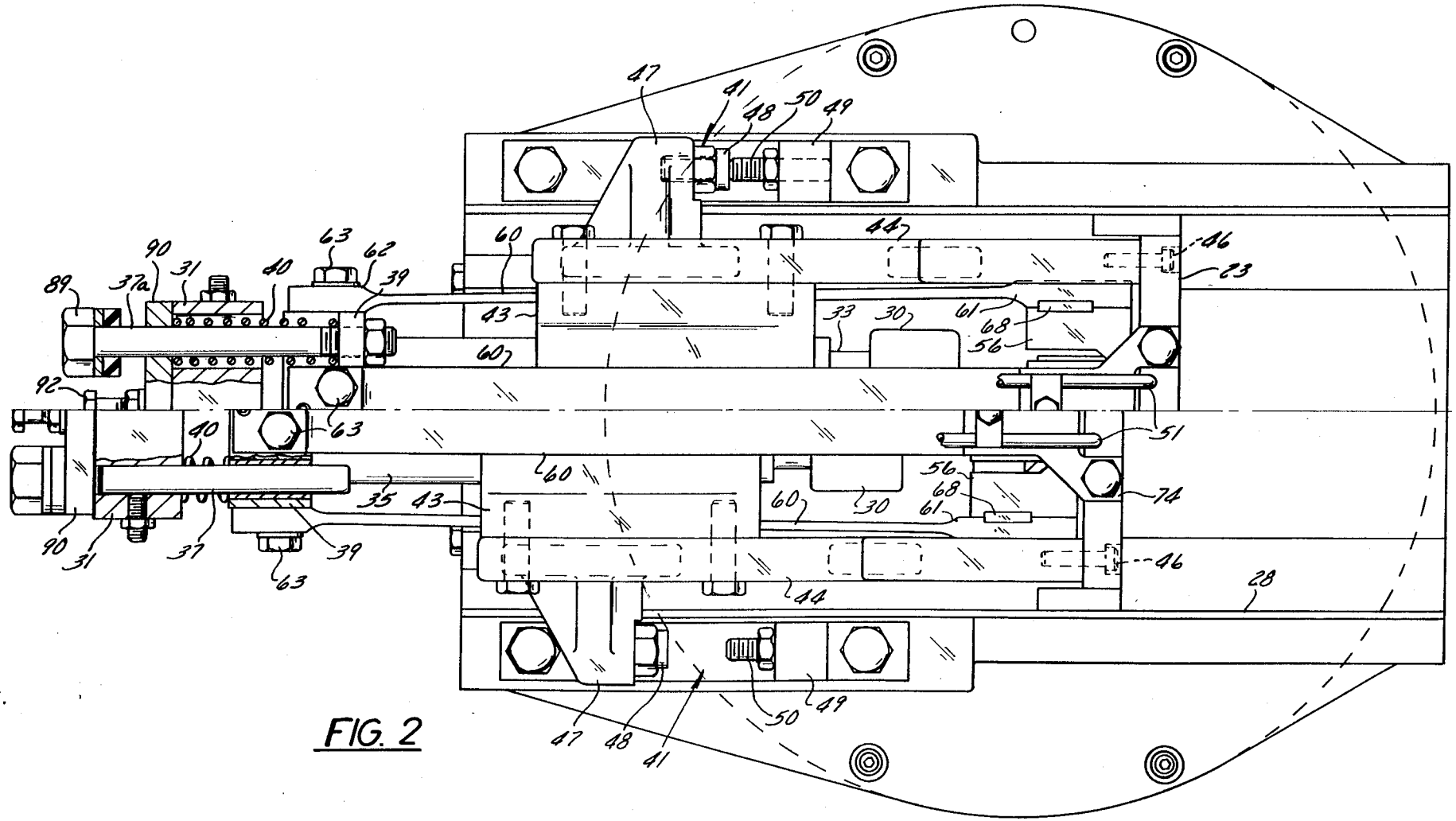
FIG. 2 is a top plan view of the bottom expander, which is shown in its advanced position in the top half of the figure and in its retracted position in the bottom half of the figure.

As shown in FIG. 1, a machine for manufacturing such containers has a stepwise rotatable turret 10 that comprises an upright post-like portion 11 from which a number of identical mandrels 12 project radially outwardly at uniform angles around the turret. Each mandrel 12 has a flat end surface 14 that faces away from the turret axis. By its stepwise rotation, the turret carries every mandrel 12 to each in turn of a number of stations that are spaced around the mandrel orbit.

As described generally hereinabove, and as is well known in the art, when a mandrel 12 arrives at a station at which a bottom expander 15 is operating, a bottom blank 7 has already been adhered by suction to its flat end surface 14, and a side blank 6 has been wrapped around it. The marginal portion of the bottom blank 7 is bent to define a peripheral flange 17 that projects axially away from the mandrel. The side blank 6, as initially wrapped around the mandrel, has a bottom marginal edge portion projecting beyond the flange 17; but before the mandrel reaches the bottom expanding station, that marginal portion of the side blank is turned inwardly around the flange 17, to lie radially inside that flange as at 18 (best seen in FIG. 6).

Thus, when a container that is being formed arrives at the bottom expanding station, its bottom rim 9 is several layers thick, and the flange 17 on its bottom blank is sandwiched between layers of its side blank. At the bottom expanding station these several layers are clamped into intimate engagement all around the bottom rim to be bonded to one another and form a sealed bottom seam.

It may be noted that when the side blank 6 is wrapped around the mandrel 12 it has overlapped side edge portions that are clamped down against the mandrel, and thus against one another, by means of a clamping bar 20 for the mandrel that partakes of turret rotation and is movable up and down relative to the mandrel. During the dwell of the turret at the bottom expanding station, the clamping bar 20 remains in its lowered clamping position to ensure a good bond at the side seam formed by the overlapped edge portions of the side blank. For bonding at the seams, coatings of a quickly setting glue may be applied to the seam-forming zones of the blanks before they are brought into engagement with the mandrel, or each blank may have an overall thermoplastic coating that is locally heated to its molten state and is cooled during the clamping operation that brings the seam forming layers into intimate bonding engagement.

The bottom expanding mechanism 15 comprises, in general, a shuttle 22 that is movable back and forth in directions parallel to the axis of a mandrel at the bottom expanding station, a ring tool 23 which is fixed on the front end of the shuttle and which is brought into surrounding relation to the bottom rim 9 of a container at the station by forward movement of the shuttle, a plurality of tool elements 24 which are confined to radial motion relative to the shuttle and which clampingly cooperate with the ring tool 23 in carrying out the bottom expanding operation, and an elongated driver 25 which is coaxial with a mandrel at the station and which is moved lengthwise forward relative to the shuttle to propel the tool elements 24 radially outward.

Figure 5:
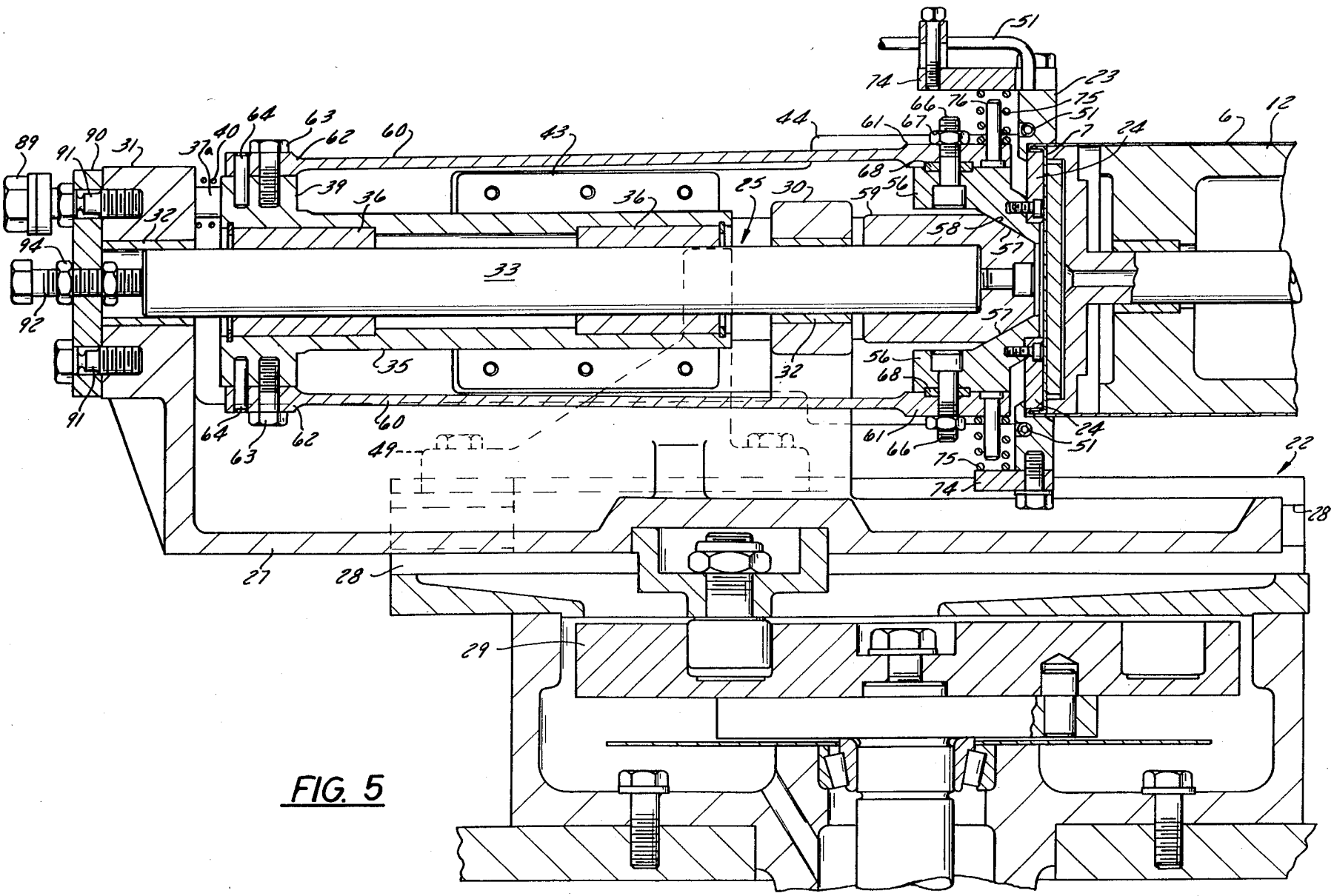
FIG. 5 is a view in vertical section through the bottom expander station, taken on its axis, showing the bottom expander in bottom-expanding engagement with a container on a mandrel at the station.

The shuttle 22 comprises, in general, a base member 27 that is mounted in guide ways 28 fixed in the machine bed whereby it is confined to back and forth motion. Such motion is imparted to the base member 27 by a cam 29 that rotates in synchronism with the turret drive, in an arrangement that is known to those familiar with paper container machines. Its back and forth motion carries the shuttle between a retracted position (illustrated in FIGS. 1 and 6) wherein it is clear of mandrels swinging into and out of the bottom expanding station, and an advanced or operating position (shown in FIGS. 5, 7 and 8).

The base member 27 has front and rear upwardly projecting bushing blocks 30, 31, the rear one 31 being rather large and the front one 30 being spaced a substantial distance forward from it; and in these bushing blocks are seated coaxial bushings 32 in which the shaft 33 of the driver 25 is supported for back and forth lengthwise motion with the shuttle.

The shuttle 22 also comprises a spider member 35 which is substantially tubular along most of its length. It surrounds the shaft 33 of the driver 25 and extends through most of the distance between the bushing blocks 30, 31 on the base member. In its front and rear end portions the spider member 35 has coaxial bushings 36 that slidably surround the driver shaft 33, so that the spider member is, in the main, supported from the base member by the driver shaft. However, the spider member is confined against rotation about the driver shaft 33 by dowels 37 that extend parallel to the driver axis between the rear bushing block 31 on the base member and a block-like rear end portion 39 of the spider member.

Reacting between the base member 27 and the spider member 35, to urge the latter forward relative to the base member for a purpose explained hereinafter, are a pair of compression springs 40, each surrounding a guide bolt **37*a*** that is secured in the rear end portion of the spider member.

Projecting more or less radially from the front portion of the spider member are four circumferentially spaced mounting pads 43 that support a pair of forwardly projecting struts 44, one at each side of the spider member, to the front ends of which the ring tool 23 is fixed. For rigid support of the ring tool on the spider member, the pads 43 have substantial length along the spider member, extending from near its front end to about its midpoint, and each strut 44 is fastened to the two pads 43 at one side of the spider member. The struts 44 project a substantial distance forwardly beyond the front bushing block 30 on the base member and the ring tool bridges across them. The edge surface 45 that is defined by the aperture in the ring tool is shaped and dimensioned to fit closely around the bottom rim 9 of a container on the mandrel at the bottom expanding station. Preferably the ring tool is detachably secured to the struts 44, as by means of capscrews 46 extending rearwardly through it and threaded into the struts, so that it can be interchanged with rings adapted for containers of other shapes and sizes. A tube 51, received in a closely fitting groove in the rear face of the ring tool, provides for circulation of cold water in heat exchange relation with it to cool the molten coating on the container blanks for bonding of the bottom seam.

Near its rear end, each of the struts 44 is formed with a laterally extending abutment bracket 47 into which is threaded a forwardly projecting bumper 48, and on the machine frame, at each side of the base member 27, there is fixed an upwardly projecting abutment bracket 49 into which is threaded a forwardly and rearwardly adjustable stop screw 50. The stop screws 50, in cooperation with the bumpers 48, comprise abutment means 41 for defining the most forward position to which the spider member 35 can be carried by the back and forth motion of the base member 27 during rotation of its driving cam 29. The stop screws 50 are adjustable for establishing a forward position of the spider member 35 at which the ring tool 23 is in proper surrounding relation to the bottom rim 9 of a container on the mandrel at the bottom expanding station. After the spider member reaches that position, the springs 40 accommodate continuing forward movement of the base member 27 as it is driven by the cam 29.

Each of the radially movable tool elements 24 is in the form of a relatively thick plate, having flat and parallel front and rear surfaces and having a radially outer edge 52 which is curved in close conformity to an opposing portion of the aperture surface 45 in the ring tool, and which thus serves as a clamping surface. Preferably this clamping surface 52 is serrated, as shown, so that is crimps the inner layer of the bottom rim to contract it peripherally and also ensures good bonding contact between the several layers that comprise the bottom rim 9. The several tool elements 24 have their flat rear surfaces disposed in a common plane which is normal to the axis of the driver 25, and which is spaced a small distance forward of the rear face of the ring tool 23.

As is conventional with bottom expander tooling for non-circular containers, the radially movable tool elements 24 are four in number, one for each long side of the container and one for each short side. As is also conventional, circumferentially adjacent tool elements are in partially overlapping relationship to one another by reason of each tool element having half-thickness portions 54 that provide endwise extensions of its clamping surface 52, each overlying an oppositely offset half-thickness portion on the neighboring tool element. These overlapping portions 54 of the tool elements ensure that the clamping surfaces 52 on the tooling will engage the bottom rim 9 of a container at every point around it, notwithstanding that the radially outward clamping movement of the tool elements 24 carries them in divergent relationship to one another.

As here shown, each of the tool elements 24 is rigidly secured to a connector member or carrier 56 whereby thrust is transmitted from the driver 25 to the tool element. For such force transmission each carrier 56 has a driven surface 57 that extends obliquely forwardly and towards the driver axis and cooperates with one of the matingly oblique driving surfaces 58 on a pyramidal head 59 of the driver. It will be understood that the securement of each tool element 24 to its carrier 56 is a detachable one, to provide for interchange of the tool elements with tooling for containers of other shapes and sizes.

For actuating the driver 25 in back and forth motion relative to the tool elements 24 and the spider member 35 that carries them, the driver shaft 33 is coaxially secured at its rear end to the rear bushing block 31 of the base member 27. Hence, as the base member 27, driven by the cam 29, continues its forward movement after forward movement of the spider member 35 is stopped by engagement of the abutments 48, 50, the driver is thereby moved forward relative to the spider member, wedgingly driving the tool elements 24 radially outward. As the base member begins its rearward return movement, carrying the driver rearward with it, the compression springs 40 that react between the base member 27 and the spider member 35 maintain the abutments 48, 50 engaged to hold the spider member in its forward position. However, the guide bolts 37*a* which the springs 40 surround, and which are secured in the rear end portion of the spider member, extend through the rear bushing block 31 on the base member and have their heads 89 behind it to provide a lost motion connection between the base member and the spider member whereby the spider member is drawn rearward with the base member during the last stage of rearward travel of the base member, thus disengaging the ring tool 23 from the container and bringing the shuttle to its retracted position.

The connection between the base member 27 and the driver shaft 33 comprises a plate 90 that overlies the rear face of the rear bushing block 31 on the base member and is secured to it by break-away bolts 91. In turn, a bolt 92 that is coaxially threaded into the rear end portion of the driver shaft 33 is secured to the plate 90 by means of nuts 94 that provide for lengthwise adjustment of the driver shaft relative to the base member 27.

In the bottom expander of this invention, the carriers 56 for the several tool elements 25 are supported and confined to radial motion by long and substantially heavy straight leaf springs 60, one for each carrier. Each leaf spring 60 has a rectangular cross-section that is uniform along most of its length, but its front and rear end portions 61 and 62, respectively, are of substantially increased thickness to serve as attachment pads, the rear attachment pad 62 being anchored to the spider member 35 and the carrier 56 for the leaf spring being rigidly secured to the front pad 61. For anchoring the leaf springs, the rectangular block-like rear end portion 39 of the spider member has four side surfaces, each overlain by the rear pad 62 of a leaf spring. A pair of capscrews 63 extend through the rear pad 62 and are threaded into the spider member, and supplementing these capscrews to confine the leaf spring against any sliding displacement relative to the spider member is at least one pin 64 that is driven into aligned holes that are drilled through the leaf spring pad and into the spider member after the capscrews are fastened, in spaced relation to the capscrews. By its securement to the spider member each leaf spring is disposed with its wider side surfaces normal to a plane containing the driver axis; hence the leaf spring is confined to flexing that carries its front end towards and from that axis. Correspondingly, the carrier 56 and the tool element 24 that are secured to the front end of the leaf spring, which are supported and guided only by it, are confined by it to radially in and out motion. It will be apparent that each leaf spring, when in its unflexed condition, disposes its tool element 24 in a retracted or home position (shown in FIGS. 1, 6 and 7), from which the tool element is propelled radially outwardly by forward movement of the driver 25, and that upon rearward movement of the driver the flexing bias of the leaf spring returns the tool element to its home position.

It will be observed that each leaf spring 60 is disposed between a pair of the radially spaced pads 43 on the spider member, so that it can flex without interference from those pads, and that the struts 44 which extend between those pads and the ring tool 23 are formed to be well clear of their adjacent leaf springs, at the outer sides of them.

Each carrier 56 is preferably secured to its leaf spring 60 by means of a pair of capscrews 66 that extend through the carrier and the front mounting pad 61 on the leaf spring and are secured by lock nuts 67. To ensure against any sliding displacement of the carrier relative to the leaf spring, particularly under the forward component of the force that the pyramidal driver head 59 imposes upon the carrier, a block-like key 68, through which the screws 66 also extend, is confined in closely fitting grooves in the opposing surfaces of the carrier and the leaf spring. The key 68 is preferably oriented with its long dimension transverse to the length of the leaf spring.

Each tool element 24 is detachably but rigidly secured to its carrier 56 by means of a pair of cap screws 69 that extend rearwardly through the plate-like tool element and are threaded into the carrier. To cooperate with the capscrews 69 in fixing the tool element to the carrier, the carrier has a flat front surface 70 that is overlain by the flat rear surface on its tool element 24, and the carrier also has a forwardly projecting portion 71 which extends beyond its front surface 70 and defines a radially outwardly facing surface 72 that is abuttingly engaged by a radially inner edge surface 73 on the tool element. A part of the oblique driven surface 57 on the carrier is formed on its forwardly projecting portion 71.

Reacting between the front end portions of the leaf springs and spring seats 74 that are fixed on the shuttle 22 are relatively stiff coiled compression springs 75 that serve to maintain the front surfaces of the tool elements 24 in accurately coplanar relationship as the tool elements are actuated radially inwardly and outwardly.

Desirably there are at least two of the compression springs 75 for each leaf spring, with their axes on a line that extends transversely to the length of the leaf spring. The spring seat 74 against which the outer ends of the coil springs 75 for each leaf spring react comprises a sturdy lug that is fixed to the ring tool 23 and projects rearwardly therefrom in outwardly spaced, overlying relation to the front end portion of the leaf spring. Each coil spring 75 is confined in its required position by being piloted on a pin 76 which is secured in the front pad 61 of the leaf spring and projects outwardly from it, and which is short enough not to strike the spring seat lug 74 upon maximum deflection of the leaf spring.

Figure 6:
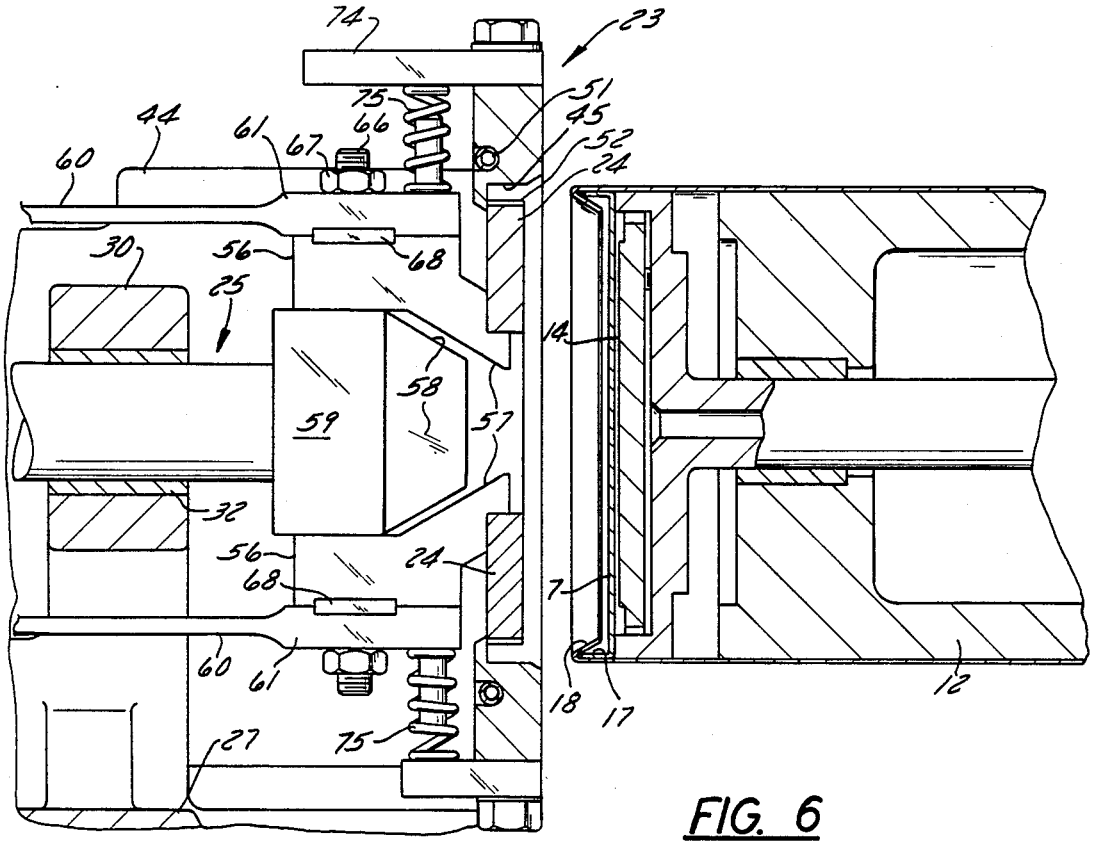
FIG. 6 is a fragmentary view in vertical section, taken on the same plane as FIG. 5 but on a larger scale, showing the bottom expander in its retracted position in relation to a mandrel at the bottom expanding station.
Figure 7:
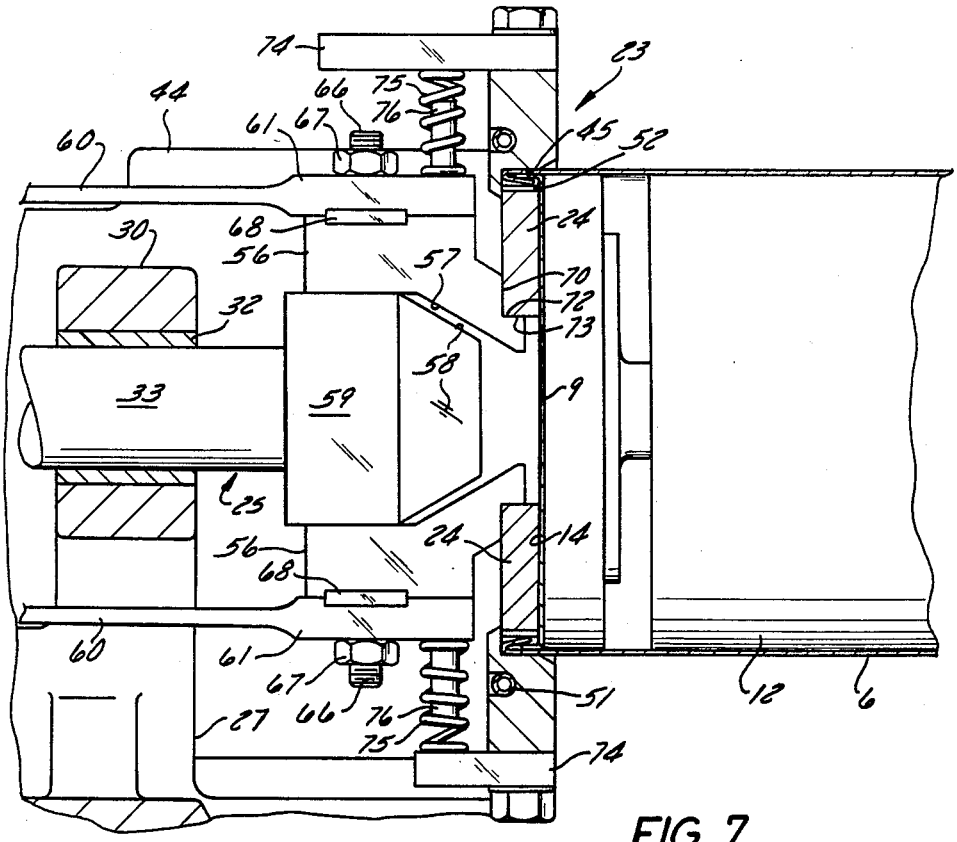
FIG. 7 is a view generally similar to FIG. 6 but showing the bottom expander in its advanced position and with the tool elements in their home positions.
Figure 8:
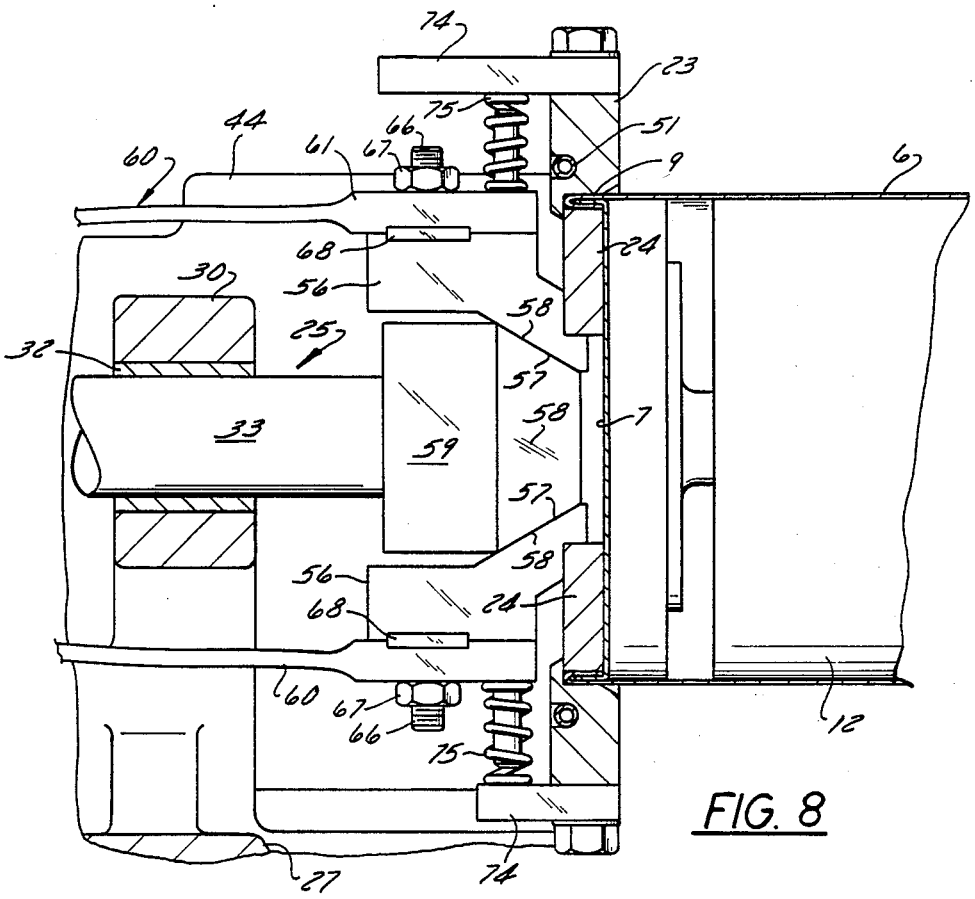
FIG. 8 is a view generally similar to FIG. 7 but showing the tool elements in their extended positions.

As best seen in FIGS. 6–8, the coil springs 75 for each leaf spring have their axes on a line which is very close to the front end of the leaf spring and which is in forwardly spaced relation to the rear end edge 77 of the oblique driven surface 57 on the carrier that the leaf spring supports. As the driver 25 begins a forward actuating movement, the oblique driving surfaces 58 on its pyramidal head 59 first apply radially outward force to the driver surfaces 57 near their rear end edges 72, behind the line of coil springs 75, and therefore radially opposite forces are imposed upon the leaf spring, by the driver head and by the coil springs, at locations that are spaced apart along its length. Because of this force couple upon the leaf spring, it is flexed to a slightly S-shaped curvature along its length, such that the front face of its tool element 24 remains accurately normal to the driver axis as the tool element moves radially outward. Considered in another way, if the coil springs 75 were not present, each leaf spring would be flexed to a simple arc along its length as its front end was swung outward by action of the driver, and the tool elements would thus be tilted out of coplanar relationship; whereas the S-like flexing that is imposed upon the leaf springs by the coil springs 75 maintains the tool elements coplanar.

As the driver 25 approaches the front end of its stroke, the tool elements 24 are in clamping engagement with the bottom rim 9 of the container, and the radially outward force that the driver is applying to each of them is being resisted by the ring tool 23. Note that each tool element 24, in being mounted on the forwardly projecting portion 71 of its carrier, is located some distance forward of the front end of its leaf spring, and therefore the force couple produced by the driver 25 and the reaction of the ring tool 23 would now tend to tilt the tool element about the bottom rim, in the direction to swing the radially inner edge of the tool element rearward. The coiled springs 75, however, are exerting their radially inward force against the leaf spring on a line that is spaced some distance behind the container bottom rim that forms the fulcrum about which the tool elements thus tend to pivot or swing, and the force that they exert now prevents the leaf spring from assuming an excessive S-curvature that would permit such tilting of the tool element.

From the foregoing description taken with the accompanying drawings it will be apparent that this invention provides a bottom expander mechanism for a machine for making two-piece paper containers wherein there are no sliding surfaces on the tool element carriers for guiding them in their radially in and out motion, but wherein the tool elements are nevertheless accurately confined to such motion by simple and inexpensive means that also serve to bias them towards their retracted or home positions.

I claim:

1. A bottom expander for use in making cup-like paper containers, each comprising a bottom blank and a side blank that are joined at a layered bottom rim, whereby the layers of the bottom rim are forced into bonding engagement with one another to form a seal around that rim, said bottom expander comprising a ring tool having an aperture within which a bottom rim is closely receivable and which defines an inner edge surface that surrounds and faces an axis, and a plurality of plate-like tool elements confined to edgewise movement in a common plane normal to said axis and each having a radially outer edge surface that is clampingly cooperable with said inner edge surface upon radially outward movement of the tool element from a home position thereof, said bottom expander being characterized by:

A. a supporting member having portions through which said axis extends;

B. a driver comprising:
  (1) a shaft supported coaxially with said axis by said supporting member and confined thereby to forward and rearward lengthwise movement and
  (2) a head on the front end of said shaft having forwardly convergent driving surfaces whereby the tool elements are driven radially outwardly from their home positions by forward movement of the driver;

C. a spider member supported by said shaft and confined thereby against motion transverse to said axis, said spider member comprising
  (1) a tubular central portion through which said shaft slidably extends, and
  (2) a plurality of circumferentially spaced mounting pads projecting substantially radially from said central portion;

D. cooperating means on said supporting member and the spider member confining the latter against rotation about said shaft and defining a normal position of the spider member relative to the supporting member;

E. a plurality of elongated leaf springs, one for each tool element,
  (1) each having a front end portion to which its tool element is fixed for support by the leaf spring, and
  (2) each having a rear end portion which is so fixed to a rear end portion of the spider member that the leaf spring:
    (a) extends alongside said central portion of the spider member, between said mounting pads thereon, and disposes its tool element in forwardly spaced relation to the spider member, and
    (b) is oriented:
      (i) to be flexible substantially only in directions that carry its tool element toward and from said axis, and
      (ii) to yieldingly urge its tool element to its home position; and F. rigid means fixed to said mounting pads on the spider member, projecting forwardly therefrom at opposite sides of said axis and to front end portions of which the ring tool is fixed to be supported with its inner edge surface opposite the outer edge surfaces on the tool elements.

2. The bottom expander of claim 1, further characterized by:

G. a carrier for each tool element whereby the tool element is connected with its leaf spring, each carrier having:
(1) a forwardly projecting portion upon which its tool element is secured in forwardly spaced relation to the leaf spring, and
(2) a driven surface complementary to one of said driving surfaces and at least a rear portion of which is behind the front end of the leaf spring and is slidingly engaged by that driving surface during forward movement of the driver;
H. a rigid spring seat abutment for each leaf spring, supported by said rigid means and having a spring seat surface that opposes the front end portion of its leaf spring at the side thereof remote from said axis; and
I. spring means reacting between each said spring seat surface and its opposing front end portion of a leaf spring to constrain the leaf spring to compound flexing whereby its tool element is confined to translatory motion to and from its home position.

3. The bottom expander of claim 1 wherein said supporting member is confined to movement through a predetermined distance in directions parallel to said axis and wherein said spider member is disposed in front of said supporting member, further characterized by:
G. means rigidly securing said shaft, at a rear end portion thereof, to said supporting member so that said shaft is constrained to move axially through said distance with the supporting member; and
H. spring means reacting between said supporting member and a rear end portion of said spider member to urge the spider member forward relative to the supporting member and permit the supporting member to move forward relative to the spider member.

4. The bottom expander of claim 2 wherein each said spring seat abutment is detachably secured to said ring tool, at a side thereof, and projects rearwardly from the ring tool.

5. A bottom expander for use in making cup-like paper containers, each comprising a bottom blank and a side blank that are joined at a layered bottom rim, whereby the layers of the bottom rim are forced into bonding engagement with one another to form a seal around that rim, said bottom expander comprising a shuttle that defines an axis, a ring tool having an aperture within which a bottom rim is closely receivable and which defines an inner edge surface that surrounds and faces said axis, a plurality of plate-like tool elements disposed in a common plane normal to said axis and each having a radially outer force applying edge surface cooperable with said inner edge surface of the ring tool, and a driver movable forward and rearward along said axis relative to the shuttle and having driving surfaces that are inclined forwardly towards said axis and whereby the tool elements are driven radially outwardly from home positions in consequence of forward movement of the driver, said bottom expander being characterized by:
A. a plurality of elongated leaf springs, one for each tool element, each having a front end portion and a rear end portion,
(1) each having its rear end portion secured to the shuttle in rearwardly spaced relation to the ring tool and at a fixed distance therefrom and so disposed that the leaf spring, when unflexed, has its length substantially parallel to said axis, and
(2) each being flexible substantially only in directions that carry its front end toward and from said axis;
B. a carrier for each leaf spring whereby the tool element for the leaf spring is connected with the leaf spring, each carrier being fixed to the front end portion of its leaf spring and having
(1) a forwardly projecting portion upon which its tool element is secured in forwardly spaced relation to the leaf spring, and
(2) a driven surface complementary to one of said driving surfaces and at least a rear portion of which is behind the front end of the leaf spring and is slidingly engaged by that driving surface during forward movement of the driver;
C. a spring seat abutment on the shuttle for each leaf spring, each said spring seat abutment being in rigidly fixed relation to the ring tool, rearwardly adjacent thereto, and having a spring seat surface which opposes and is spaced from the front end portion of its leaf spring at the side thereof remote from said axis; and
D. spring means reacting between each said spring seat surface and its opposing front end portion of a leaf spring to yieldingly oppose motion of said front end portion of the leaf spring away from said axis and thus constrain the leaf spring to compound flexing whereby its tool element is confined to translatory motion outwardly away from and inwardly to said home position.

6. In a bottom expander for use in making flat bottom cup-like paper containers, comprising a ring tool having an aperture that defines an inner edge surface which surrounds an axis and which can closely embrace a bottom rim of a container, supporting means confining said ring tool against movement transversely to said axis, and a plurality of plate-like tool elements, each having a radially outer edge surface that opposes and is clampingly cooperable with said inner edge surface, guide means whereby said tool elements are maintained coplanar and each is confined to translatory motion in opposite directions transverse to said axis, said guide means comprising:
A. a plurality of elongated leaf springs, one for each tool element, each said leaf spring being formed in one piece that comprises
(1) an elongated medial portion
(a) with a width greater than its thickness, to be lengthwise flexible transversely to its width, and
(b) with a rectangular cross-section that is uniform along the length of said medial portion,
(2) a front end portion formed as a front pad which is of substantially greater thickness than said medial portion, and
(3) a rear end portion formed as a rear pad that is of substantially greater thickness than said medial portion;
B. means rigidly anchoring said rear end portion of each leaf spring to said supporting means in a location thereon that is spaced rearwardly at a fixed distance along said axis from the ring tool and whereby the leaf spring is oriented to have its medial portion lengthwise substantially parallel to said axis and its front end portion flexible towards and from said axis;
C. a driver movable forward and rearward along said axis relative to the ring tool and having driving surfaces that are inclined forwardly towards said axis and whereby the tool elements are driven radially outwardly from home positions in consequence of forward movement of the driver;

D. a carrier for each tool element, each carrier being rigidly secured to the front end portion of the leaf spring for the tool element and having (1) a forwardly projecting portion upon which its tool element is rigidly secured in forwardly spaced relation to said front end portion of the leaf spring, and (2) a driven surface complementary to one of said driving surfaces and at least a rear portion of which is behind the front end of the leaf spring and is slidingly engaged by that driving surface during forward movement of the driver;

E. a rigid spring seat abutment for each leaf spring, supported by said supporting means, rearwardly adjacent to the ring tool and in fixed relation to it, there being on each said abutment a spring seat surface that opposes and is spaced from the front end portion of its leaf spring at the side thereof remote from said axis; and F. spring means reacting between each said spring seat surface and its opposing front end portion of a leaf spring to yieldingly oppose flexing of said front end portion of the leaf spring away from said axis and thus constrain the leaf spring to compound flexing whereby its tool element is confined to translatory motion to and from its home position.

* * * * *